US008851401B2

(12) United States Patent
Overman et al.

(10) Patent No.: US 8,851,401 B2
(45) Date of Patent: Oct. 7, 2014

(54) FLAT FAN AIR ASSIST INJECTORS

(75) Inventors: Nicholas R. Overman, West Des Moines, IA (US); John E. Short, Norwalk, IA (US)

(73) Assignee: Delavan Inc., West Des Moines, IA (US)

( * ) Notice: Subject to any disclaimer, the term of this patent is extended or adjusted under 35 U.S.C. 154(b) by 852 days.

(21) Appl. No.: 13/083,213

(22) Filed: Apr. 8, 2011

(65) Prior Publication Data

US 2012/0234944 A1 Sep. 20, 2012

Related U.S. Application Data

(60) Provisional application No. 61/454,356, filed on Mar. 18, 2011.

(51) Int. Cl.
*B05B 7/30* (2006.01)
*F23D 11/10* (2006.01)
*F23R 3/28* (2006.01)

(52) U.S. Cl.
CPC ..... *F23R 3/28* (2013.01); *F23D 11/106* (2013.01); *F23D 2900/11101* (2013.01)
USPC ..... 239/343; 239/344

(58) Field of Classification Search
CPC ..... B05B 7/0869; B05B 7/0416
USPC ..... 239/343, 344, 354, 398, 428.5, 429
See application file for complete search history.

(56) References Cited

U.S. PATENT DOCUMENTS

| | | | | |
|---|---|---|---|---|
| RE23,149 | E | 9/1949 | Lubbock et al. | |
| 3,220,801 | A * | 11/1965 | Rill, Jr. et al. | 422/133 |
| 4,001,357 | A * | 1/1977 | Walz et al. | 264/12 |
| 5,076,061 | A | 12/1991 | Shekleton et al. | |
| 7,464,553 | B2 | 12/2008 | Hsieh et al. | |
| 7,565,803 | B2 | 7/2009 | Li et al. | |
| 7,581,396 | B2 | 9/2009 | Hsieh et al. | |
| 7,762,073 | B2 | 7/2010 | Li et al. | |
| 2004/0209129 | A1 | 10/2004 | Carrea | |
| 2005/0155351 | A1 | 7/2005 | Wunning et al. | |
| 2008/0083224 | A1 | 4/2008 | Varatharajan et al. | |
| 2009/0113893 | A1 | 5/2009 | Li et al. | |

OTHER PUBLICATIONS

Guillou, Erwann, "Flame Characteristics and Application of Flameless Combustion," A thesis submitted to the Graduate Faculty of the University of cincinnati, Dec. 2, 2007.

Invitation to Rectify Deficiencies for Swedish Application No. 1050460-3 (Apr. 4, 2011).

UK Search Report dated Jul. 13, 2010 for GB 1007945.7.

* cited by examiner

*Primary Examiner* — Davis Hwu

(74) *Attorney, Agent, or Firm* — Edwards Wildman Palmer LLP; Scott D. Wofsy; Joshua L. Jones

(57) ABSTRACT

An injector for injecting a flat fan of liquid includes an injector body defining a pair of air channels, with each air channel fluidly connected to a respective air inlet. The air channels join one another at a common throat defined in the injector body and are separated by a land defined in the injector body extending from the air inlets to a point proximate the throat. The air channels and a liquid inlet are in proximity to draw liquid out of the liquid inlet into the throat with air flowing through the air channels. A diverging diffuser is provided in fluid communication with the throat. The diffuser includes an impingement surface defined in the injector body opposed to the liquid inlet. The liquid inlet is configured to inject liquid against the impingement surface to form a fan of liquid diverging outward through the diffuser.

20 Claims, 12 Drawing Sheets

Fig. 7a
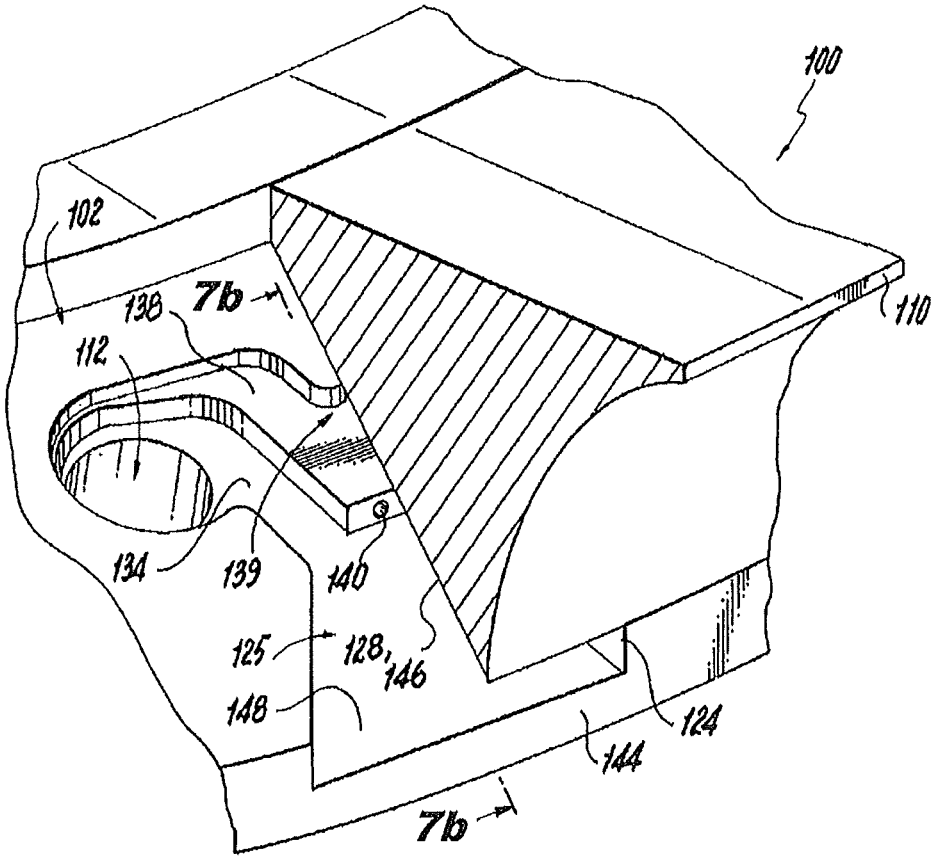
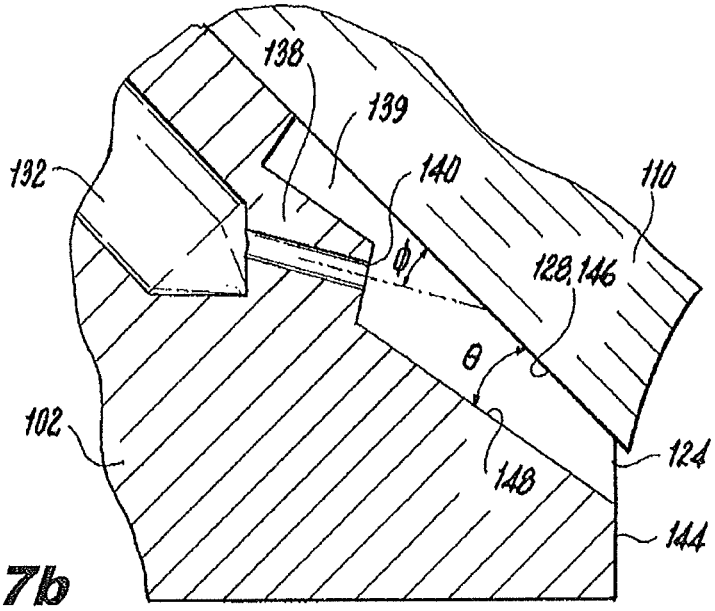
Fig. 7b

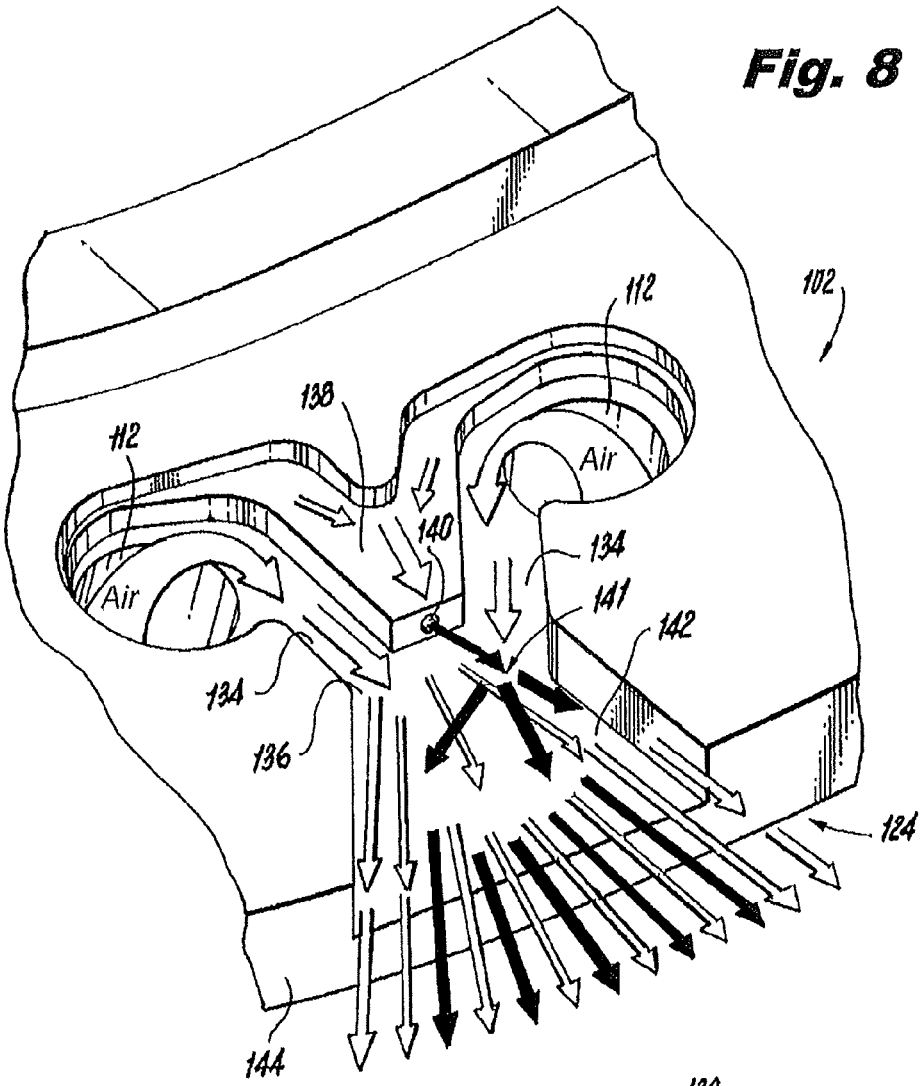
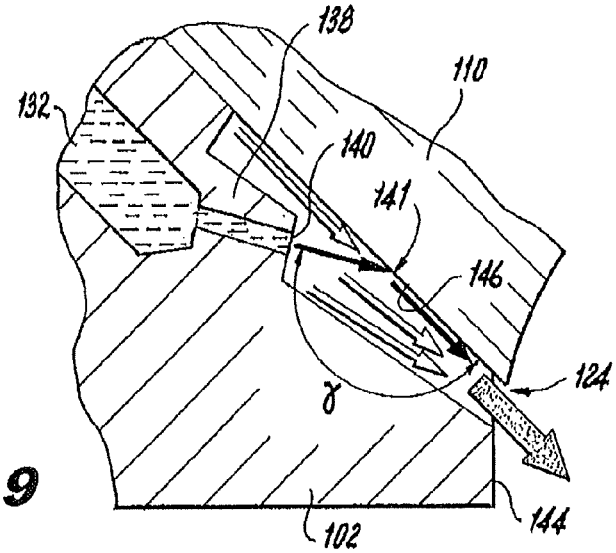
Fig. 9

Fig. 12
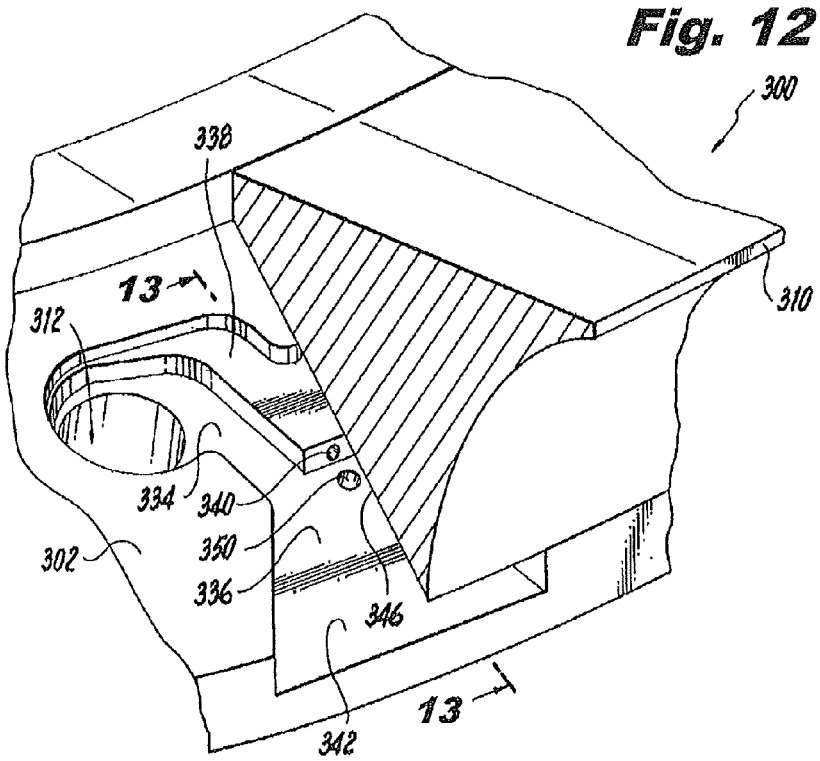
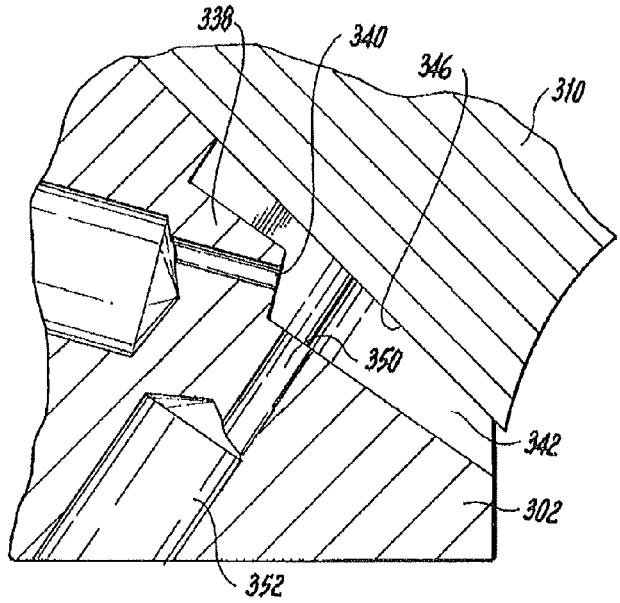
Fig. 13

FLAT FAN AIR ASSIST INJECTORS

CROSS-REFERENCE TO RELATED APPLICATIONS

This application claims priority to U.S. Provisional Patent Application No. 61/454,356 filed Mar. 18, 2011, which is incorporated by reference herein in its entirety.

BACKGROUND OF THE INVENTION

1. Field of the Invention

The present invention relates to injectors and nozzles, and more particularly to injectors and nozzles for injection of liquids.

2. Description of Related Art

Enabling the breakup of large liquid bulk flow into a fine spray has always been a challenge, particularly in fuel injection applications for example. For simplex pressure atomizers, in order to obtain high flow rates, the liquid supply pressure must increase dramatically, or the orifice must be enlarged. Often high pressure is not feasible, and droplet size tends to get larger as the orifice diameter increases. Air assist or prefilming air-blast nozzles are commonly used to atomize sprays when pressurized air is available. The air-blast method relies on the shearing effect of high velocity air to provide atomization. Often, an upstream trim orifice is incorporated which aids in flow calibration. The pressure drop taken across the trim orifice wastes energy which could potentially be used for atomization.

In some cases, multiple injection points have been employed to disperse a flow, reducing each stream to a more manageable volume. However, there tend to be downsides to conventional multiple injection techniques, such as complex geometry, large part count, limited physical space, maintaining balanced flow rate at all injection points, poor downstream patternation, small passage sizes prone to plugging, external carbon build up due to wetted surfaces, and heat shielding difficulties.

Such conventional methods and systems generally have been considered satisfactory for their intended purpose. However, there still remains a continued need in the art for multi-point injectors that allow for effective break up of bulk liquids with simplified geometry, improved spray patternation, and simplified heat shielding capabilities. The present invention provides a solution to these problems.

SUMMARY OF THE INVENTION

The subject invention is directed to a new and useful injector for injecting a flat fan of liquid. The injector includes an injector body defining a pair of air channels, with each air channel fluidly connected to a respective air inlet. The air channels join one another at a common throat defined in the injector body and are separated by a land defined in the injector body extending from the air inlets to a point proximate the throat.

A liquid inlet is defined in the land proximate the throat. The air channels and liquid inlet are in proximity to draw liquid out of the liquid inlet into the throat with air flowing through the air channels. A diffuser is provided in fluid communication with the throat. The diffuser has a width that diverges over a length from the throat to an outlet of the injector body. The diffuser includes an impingement surface defined in the injector body opposed to the liquid inlet. The liquid inlet is configured to inject liquid against the impingement surface to form a fan of liquid spray diverging outward through the diffuser.

In certain embodiments the diffuser includes a diffuser surface opposite the impingement surface. The diffuser surface and the impingement surface converge toward one another at a predetermined compression angle over the length from the throat to the outlet of the injector body.

The liquid inlet can include a liquid inlet bore in the injector body that is angled obliquely with respect to the impingement surface of the diffuser. The liquid inlet and liquid inlet bore can thus be configured and adapted to form an obtuse angle in a flow of liquid issuing from the liquid inlet at a point where the flow of liquid meets the impingement surface of the diffuser.

In accordance with certain embodiments, an impingement air inlet is included opposite the impingement surface of the diffuser downstream of the liquid inlet. The impingement air inlet is configured and adapted to inject a jet of air toward the impingement surface and toward a flow of liquid issuing from the liquid inlet to enhance impingement of the flow of liquid on the impingement surface.

The outlet of the injector body can be defined in an exterior outlet surface of the injector body, and the outlet surface can be oriented obliquely with respect to the impingement surface of the diffuser. It is also contemplated that the liquid inlet can be offset upstream from the throat of the diffuser.

The invention also provides a multi-point injector. The multi-point injector includes an injector ring having a liquid opening for receiving liquid from an external source, the opening being in fluid communication with an internal liquid passage within the injector ring. The injector ring also includes a plurality of injectors. Each injector includes a pair of air channels, a liquid inlet, and a diffuser as described above, with the liquid inlet being in fluid communication with the internal liquid passage of the injector ring.

In another aspect of the invention, a multi-point injector includes a liquid distributor ring having a liquid opening for receiving liquid from an external source. An injection manifold ring is mounted to the liquid distributor ring with an internal liquid passage in fluid communication with the liquid opening. The internal liquid passage is defined between the liquid distributor ring and the injection manifold ring.

The injection manifold ring includes a plurality of injectors. Each injector includes a pair of air channels, each air channel fluidly connected to a respective air inlet defined radially through the injection manifold ring. Each pair of channels join one another at a common throat defined in the injection manifold ring and are separated by a land defined in the injection manifold ring extending from the air inlets to a point proximate the throat.

Each injector also includes a liquid inlet defined in the land proximate the throat in fluid communication with the internal liquid passage. The air channels and liquid inlet are in proximity to draw liquid out of the liquid inlet into the throat with air flowing through the air channels. A diffuser is provided in fluid communication with each throat, wherein the diffuser has a width that diverges over a length from the throat to an outlet of the injector.

The multi-point injector also includes an impingement ring mounted to the injection manifold ring, wherein the impingement ring includes an impingement surface disposed opposed to the liquid inlet of the injection manifold ring, and wherein each liquid inlet is configured to inject liquid against the impingement surface to form a fan of liquid spray diverging outward through the diffuser thereof.

In certain embodiments, the multi-point injector includes a heat shield ring mounted to the liquid distributor ring and to the injection manifold ring. An insulation space is defined between a radially outer surface of the heat shield ring and the internal liquid passage to thermally isolate the internal liquid passage from conditions external to the heat shield ring. The heat shield ring can form a portion of the internal liquid passage with the liquid distributor ring.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 7*a* is a partial cross-sectional perspective view of the fuel and air injection chamber of the injector ring of FIG. 6, showing the impingement plate in place;

FIG. 7*b* is a cross-sectional view of the fuel and air injection chamber of FIG. 6, showing the impingement angle and the compression angle;

FIG. 8 is a perspective view of the fuel and air injection chamber of FIG. 6, schematically showing flows of air and fuel through the chamber;

FIG. 9 is a cross-sectional view of the fuel and air injection chamber of FIG. 7*b*, schematically showing flows of fuel and air through the chamber;

FIG. 12 is partial cross-sectional perspective view of a fuel and air injection chamber of another exemplary embodiment of an injector constructed in accordance with the present invention with the impingement plate in place, showing a third air inlet proximate the throat of the converging-diverging flow path; and FIG. 13 is a cross-sectional view of the fuel and air injection chamber of FIG. 12, showing air and fuel passages passing through the injector ring.

DETAILED DESCRIPTION OF THE PREFERRED EMBODIMENTS

Figure 1A:
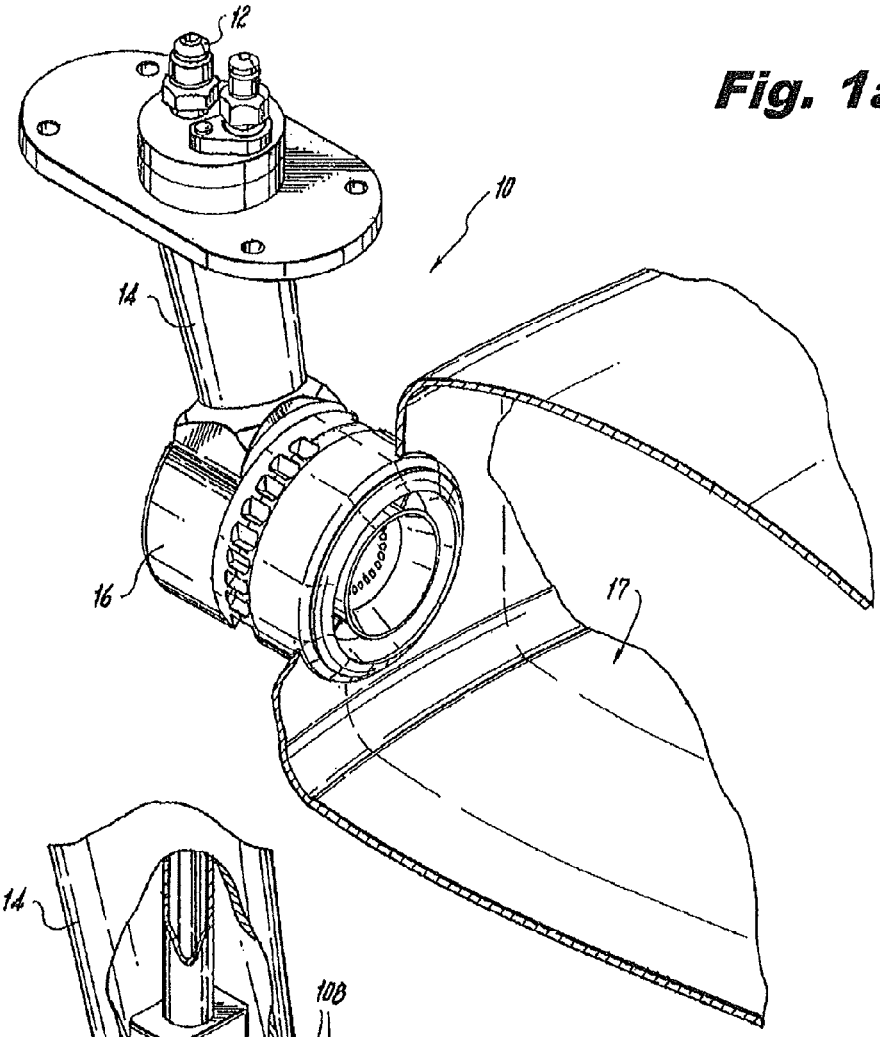
FIG. 1*a* is a perspective view of an exemplary embodiment of a recirculation product injection nozzle constructed in accordance with the present invention, showing the nozzle mounted in a combustor, which is shown partially cut away.
Figure 1B:
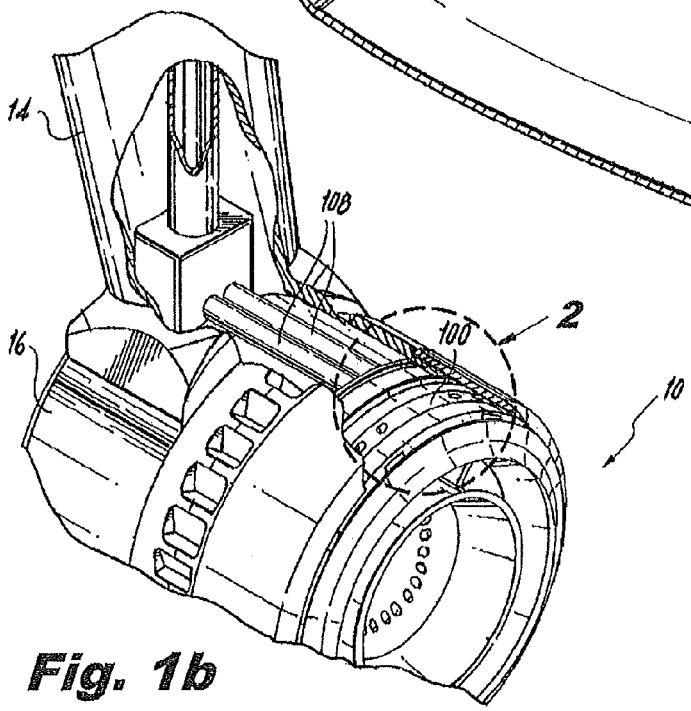
FIG. 1*b* is a partially cut away perspective view of the recirculation product injection nozzle of FIG. 1*a*, showing a multi-point injector constructed in accordance with the present invention mounted in the nozzle as part of an outer fuel injector circuit thereof.

Reference will now be made to the drawings wherein like reference numerals identify similar structural features or aspects of the subject invention. For purposes of explanation and illustration, and not limitation, a partial view of an exemplary embodiment of an injector in accordance with the invention is shown in FIGS. 1*a* and 1*b* and is designated generally by reference character 100. Other embodiments of injectors in accordance with the invention, or aspects thereof, are provided in FIGS. 2-13, as will be described. The system of the invention can be used to deliver a spray of liquid droplets in a flat, fan shaped spray pattern.

The systems and methods of the present invention can be used, for example, in operation in a gas turbine combustor. While the injection devices of the present invention use an air assist configuration to provide the desired spray patternation, unlike traditional air assist devices, the oxidizer passing through the device, e.g., air, is a means to assist in dispersing fuel in a fan shape and to assist in atomization of the fuel, and need not necessarily provide a fully premixed combustible mixture of fuel and atomizer. This can be achieved by providing a fuel-to-air ratio above the rich combustion limit of the fuel, such that combustion will not occur within the device, but only external to the device after additional oxidizer is added within a downstream combustion chamber, for example.

An injector 10 includes an inlet fitting 12, where a liquid such as fuel is fed into injector 10, a feed arm 14 depending from inlet fitting 12, and a nozzle body 16 depending from feed arm 14 for injecting a mixture of upstream air and a liquid from inlet fitting 12 into a space downstream of nozzle body 16, such as into a combustor 17 in a gas turbine engine. An exemplary injector of this type is described in U.S. Provisional Patent Application No. 61/454,356. The cut away portion of FIG. 1*b* reveals multi-point injector 100 mounted as an outer fuel injector within nozzle body 16.

Figure 2:
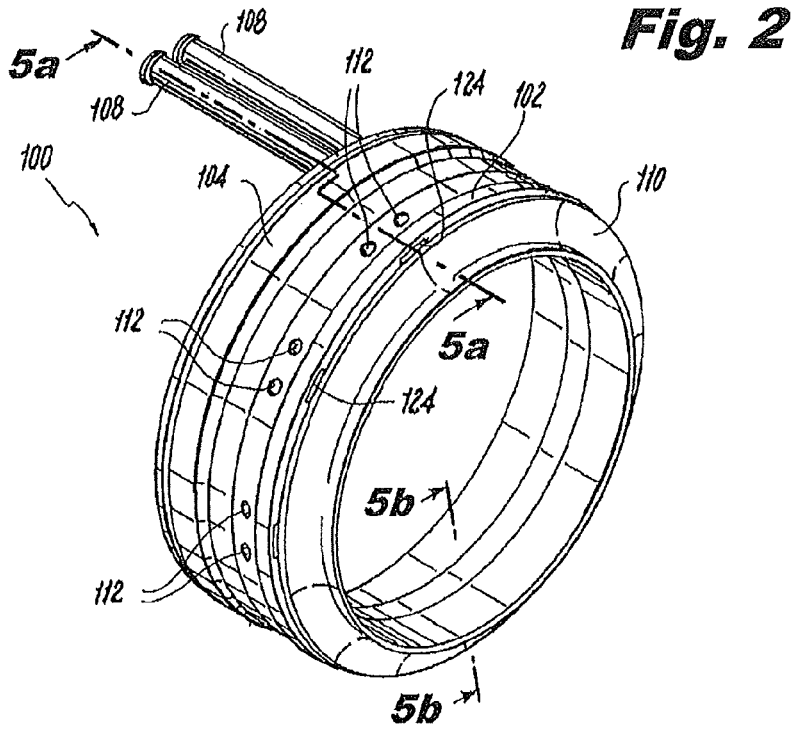
FIG. 2 is a perspective view of the multi-point injector of FIG. 1*b*, showing the air inlets and fuel inlet conduits.

Referring now to FIG. 2, multi-point injector 100 is shown removed from nozzle body 16 of injector 10. Multi-point injector 100 includes an injection manifold in the form of an annular or ring shaped injector ring 102. An annular heat shield 104 is mounted to injector ring 102, and an annular fuel distributor 106 is mounted to heat shield 104 and injector ring 102. A pair of fuel conduits 108 feed liquid, such as fuel from an external source, from inlet fitting 12 (shown in FIG. 1*a*) into respective openings in multi-point injector 100. A ring shaped impingement plate 110 is mounted to a downstream face of injector ring 102, and includes a filleted downstream face configured to assist in forming a recirculating flow downstream of injector ring 102, as described in U.S. Provisional Patent Application No. 61/454,356. Impingement plate 110 and injector ring 102 cooperate to form an injector body as described below in greater detail. Multi-point injector 100 is an air assist fuel injector, having air inlets 112 that are defined through injector ring 102 for supplying pressurized air from upstream of multi-point injector 100, e.g., compressor discharge air, to assist with fuel injection.

Figure 3A:
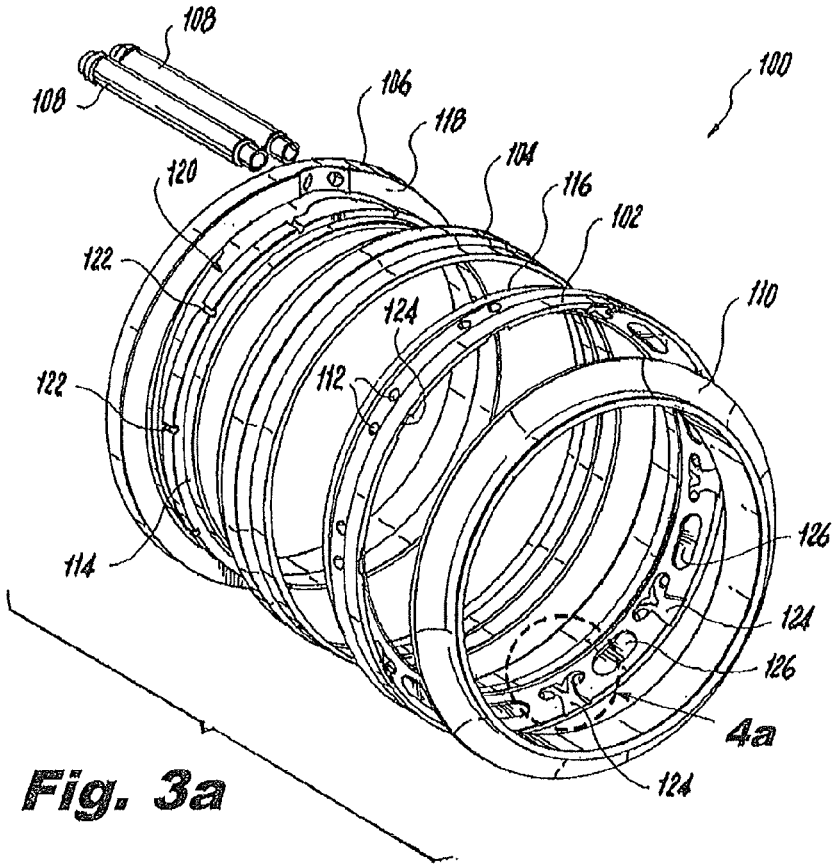
FIG. 3*a* is an exploded perspective view of the multi-point injector of FIG. 2, showing the multiple fuel and air injection chambers formed in the downstream face of the injector ring.
Figure 3B:
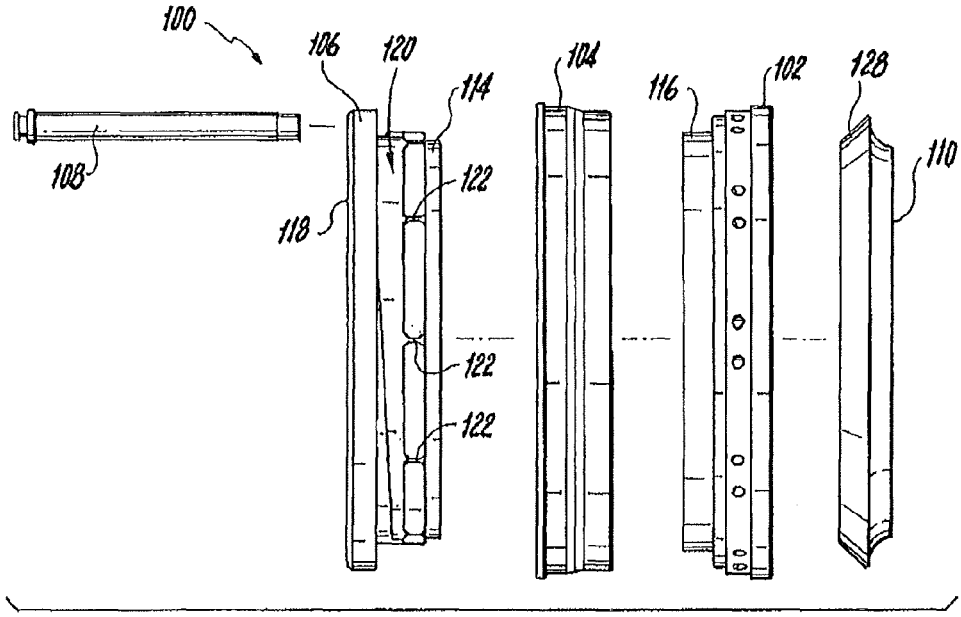
FIG. 3*b* is an exploded side elevation view of the multi-point injector of FIG. 2, showing the fuel passages formed in the fuel distributor ring, and showing the impingement surface of the impingement plate.

Referring now to FIGS. 3*a* and 3*b*, the components of multi-point injector 100 are shown separated from one another. Fuel conduits 108 are mounted directly to fuel distributor 106. Distributor 106 has a downstream flange 114 that nests radially inboard of upstream flange 116 of injector ring 102. The upstream portion of fuel distributor 106 forms an upstream bulkhead 118. Bulkhead 118 and the opposed upstream face of heat shield ring 104 form a portion of the internal liquid passage leading from fuel conduits 108 to a generally annular fuel passage 120 that encircles the outer circumference of flange 114. Fuel passage 120 narrows with respect to the axial direction, i.e., the top portion of fuel passage 120 adjacent fuel conduits 108 is wider in the axial direction than the bottom portion of fuel passage 120 opposite fuel conduits 108 across the diameter of distributor 106, as shown and oriented in FIG. 3*b*. This narrowing of fuel passage 120 helps ensure even pressure is maintained to all of the axial fuel passages 122, which pass between flanges 114 and 116. The diverging, frustoconical downstream face of injector ring 102 includes an alternating set of outlets 124 and voids 126, as shown in FIG. 3*a*. Voids 126 reduce the weight of injector ring 102 and provide thermal insulation. Outlets 124 are configured to inject a spray of fuel and air as described in greater detail below. The upstream frustoconical surface 128, shown in FIG. 3*b*, of impingement plate 110 opposes the diverging surface of injector ring 102 to enclose voids 126 and form a portion of the fuel and air outlets in conjunction with the outlet features defined in injector ring 102.

Figure 4A:
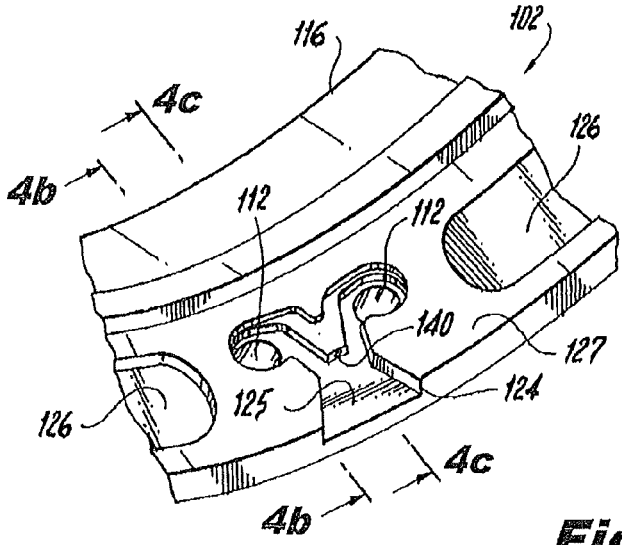
FIG. 4*a* is a perspective view of a portion of the downstream face of the injector ring of FIG. 3*a*, showing one of the fuel and air injection chambers.
Figure 4B:
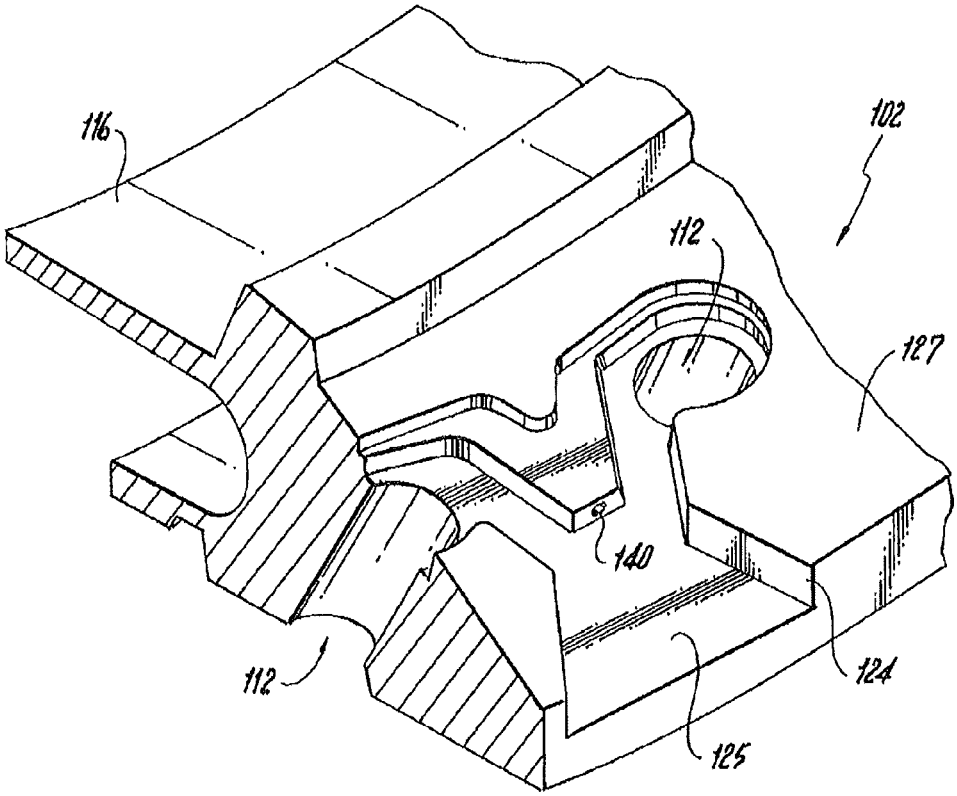
FIG. 4*b* is a cross-sectional perspective view of a portion of the fuel and air injection chamber of FIG. 4*a*, showing one of the air inlets passing through the injector ring.
Figure 4C:
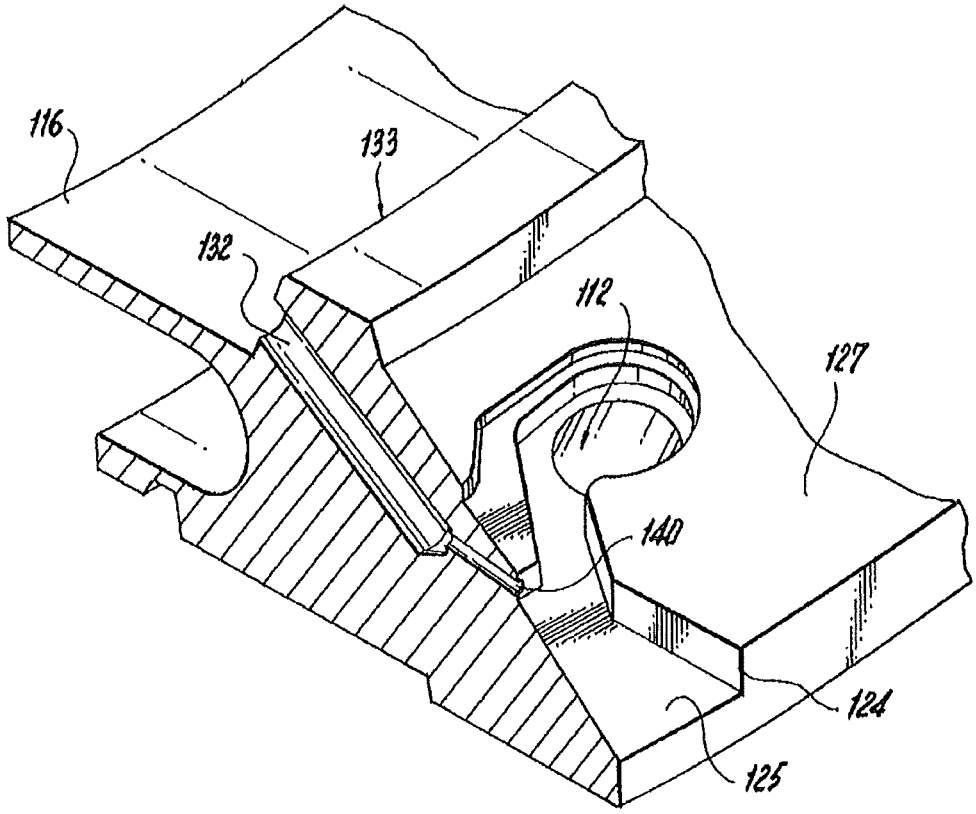
FIG. 4*c* is a cross-sectional perspective view of a portion of the fuel and air injection chamber of FIG. 4*a*, showing the fuel inlet passage through the injector ring.

Referring now to FIGS. 4*a*-4*c*, one of the fuel and air injection chambers 125 defined in the frustoconical downstream face 127 of injector ring 102 is shown in greater detail. FIG. 4*a* shows fuel inlet 140 and air inlets 112 that all feed into chamber 125, as described in greater detail below. Air inlets 112 pass from the outboard surface of injector ring 102 into chamber 125, as shown in FIG. 4*b*, wherein one of the air inlets 112 is shown in cross-section. As shown in FIG. 4*c*, fuel bore 132 places fuel inlet 140 in fluid communication with an annular fuel passage 133, that is defined between injector ring 102 and flange 114 of fuel distributor 106, as shown in FIG. 5*a*.

Figure 5A:
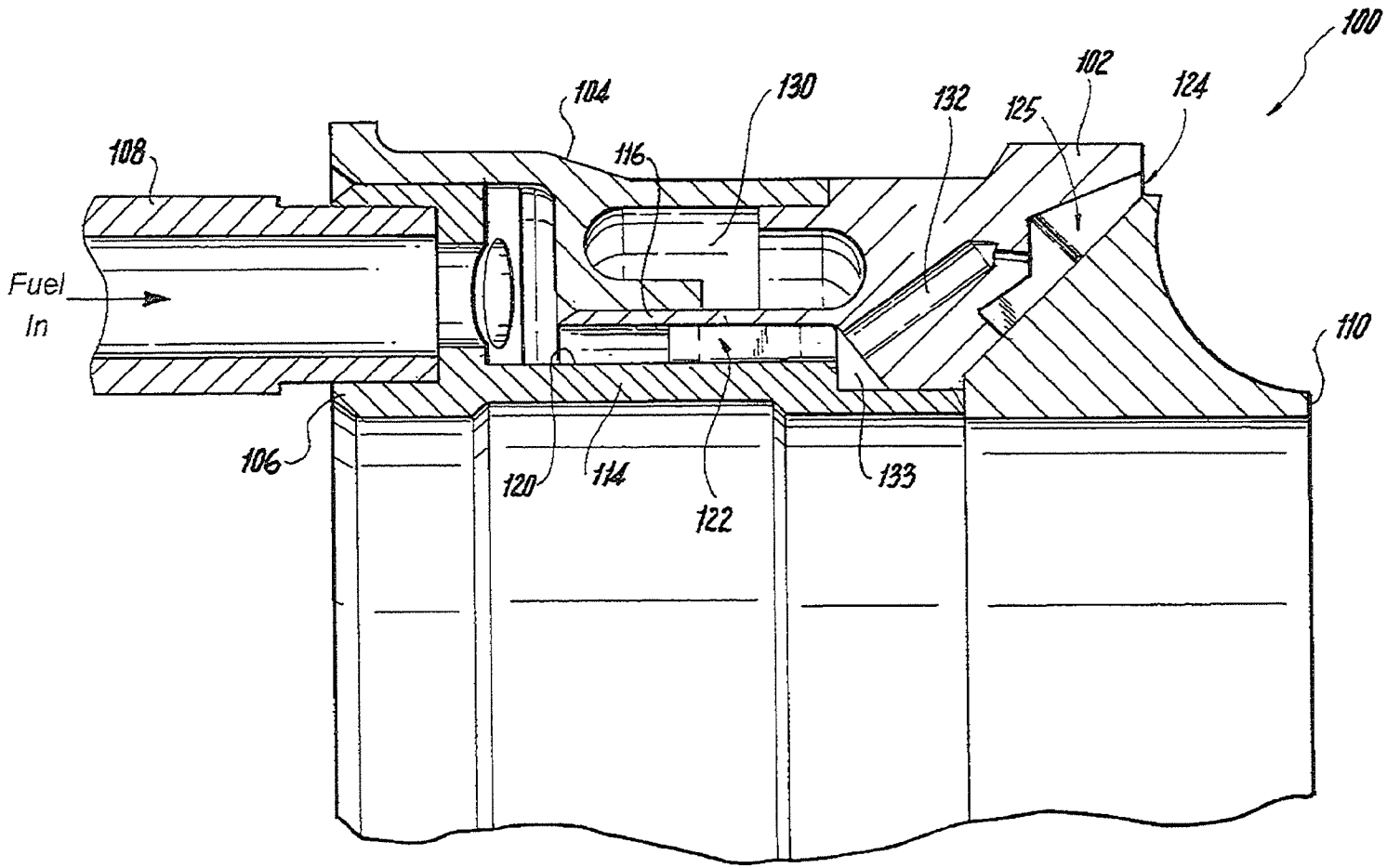
FIG. 5*a* is a cross-sectional side elevation view of the multi-point injector of FIG. 2, showing the internal fuel and air passages and the annular insulation gap proximate the fuel conduits, taken along the cross-section line indicated in FIG. 2.
Figure 5B:
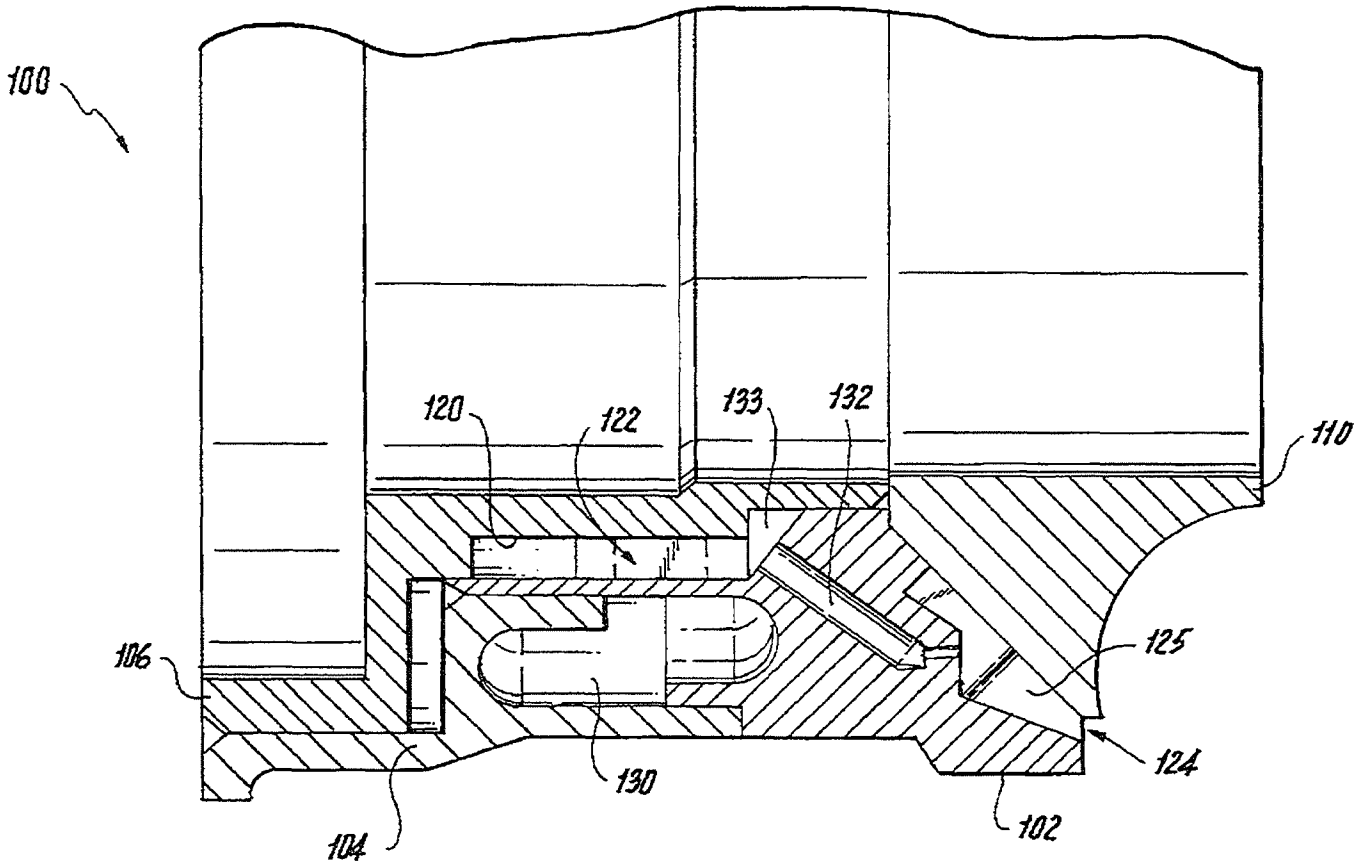
FIG. 5*b* is a cross-sectional side elevation view of the multi-point injector of FIG. 2, showing the internal fuel and air passages and the annular insulation gap in the area indicated in FIG. 2.

With reference now to FIGS. 5*a* and 5*b*, an annular insulation space 130 is formed in the space between injector ring 102 and heat shield 104. Void 130 provides thermal isolation for fuel passing through the inboard fuel passages, e.g., fuel passage 133, of multi-point injector 100 from high external temperatures. This helps reduce or eliminate build up of coke or other fuel constituents within the fuel passages of multi-point injector 100. Fuel enters multi-point injector 100 from fuel conduits 108, shown in FIG. 5*a*, passes through annular fuel passage 120, part of which is shown in FIG. 5*b*, and axial fuel passages 122 into fuel bores 132 of injector ring 102.

Figure 6:
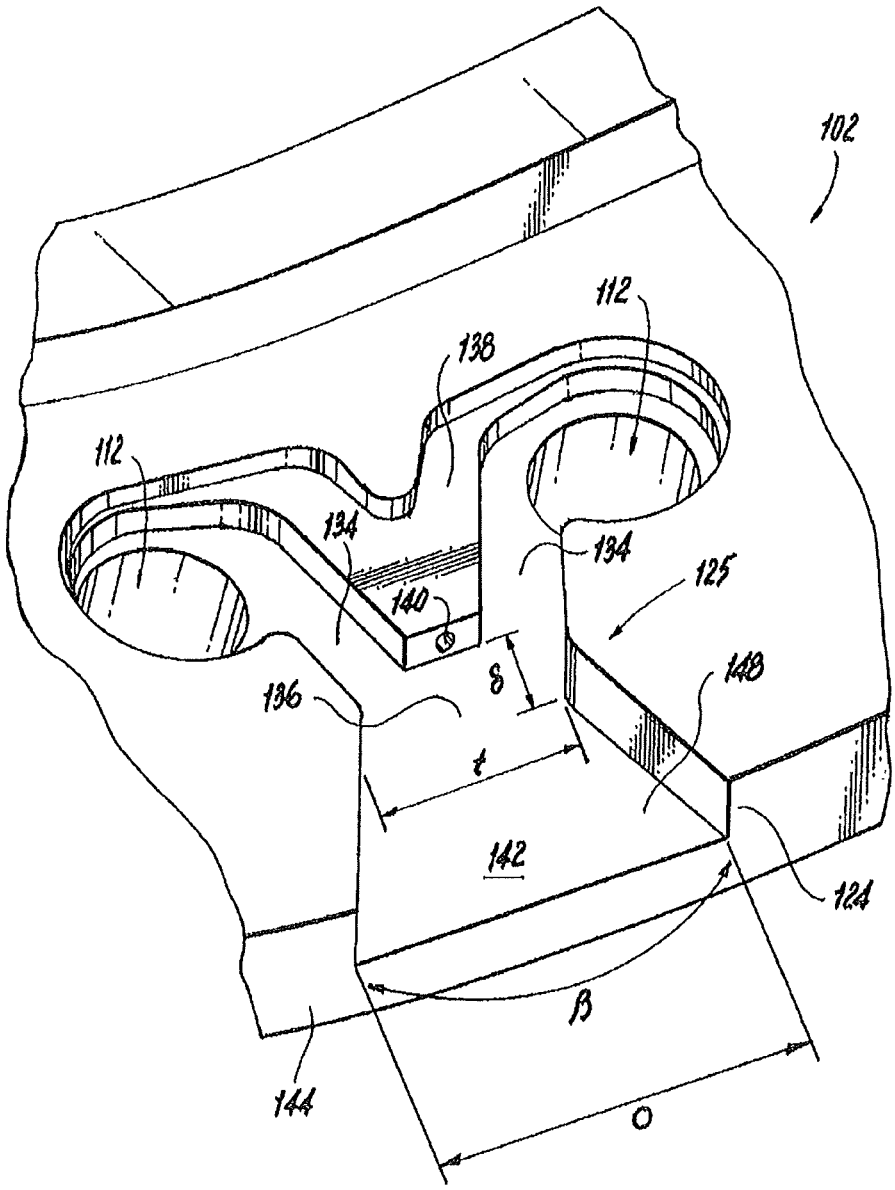
FIG. 6 is a perspective view of a fuel and air injection chamber of the injector ring of FIG. 3*a*, showing the throat width, outlet width, the diffuser angle, and the injection offset.

Referring now to FIGS. 6, 7*a*, and 7*b*, an individual outlet 124 and corresponding chamber 125 of the injector body formed by injector ring 102 and impingement plate 110 is described. A pair of air channels 134, are formed in injector ring 102 with each air channel fluidly connected to a respective air inlet 112. Each of the air channels has a rectangular cross-sectional shape when impingement plate 110 is in place as shown in FIG. 7*a*. Air channels 134, labeled in FIG. 6, join one another at a common throat 136, and are separated from one another upstream of throat 136 by a center body or land 138 defined in injector ring 102 extending from air inlets 112 upstream to a point proximate throat 136 downstream. Fuel inlet 140 is positioned in a downstream facing surface of land 138, proximate throat 136. As shown in FIG. 7*b*, liquid inlet 140 is in fluid communication with fuel bore 132 within injector ring 102, and is a bore angled obliquely with respect to impingement surface 146.

Fuel inlet 140 is offset just upstream from the narrowest portion of throat 136 by a distance δ, as shown in FIG. 6. One effect of varying the distance δ is that the siphon effect of air flow through throat 136 suctioning fuel from fuel inlet 140 increases in strength the smaller the distance δ is between throat 136 and fuel inlet 140. The distance δ also has an effect on the amount of spray interaction with the side walls of the divergent section of chamber 125 downstream of throat 136. It is contemplated that location of inlet 140 can be at any suitable location near the throat of the passage and may be slightly upstream, downstream, or right at the minimum throat area. This helps create a low pressure zone that siphons fuel out of the passage and away from the land 138 such that a lower fuel supply pressure is required for a given mass flow rate. This can also help siphon excess fuel from the internal fuel bore 132 after fuel flow is shut-off in order to prevent carbon formation within the internal fuel passages of multi-point injector 100.

Air channels 134 and fuel inlet 140 are in proximity with one another to draw fuel out of fuel inlet 140 into throat 136 using air flowing through air channels 134. A diffuser 142 is provided in fluid communication with throat 136. Diffuser 142 has a width that diverges over the length from width t at throat 136 to width O at outlet 124 of injector ring 102, defining a diffuser angle β. Varying width t of throat 136 is possible—the greater the width t, the slower the air velocity passing therethrough. The width t should not be so wide as to form a large air buffer between the liquid sheet (spray fan) and the side walls of chamber 125, as such would tend to reduce the effectiveness of the air flow in assisting in atomization.

Diffuser 142 includes an impingement surface 146 opposed to fuel inlet 140. Impingement surface 146 is part of the frustoconical surface 128 of impingement plate 110, as shown in FIG. 7*a*. With this arrangement, fuel inlet 140 can inject liquid fuel against impingement surface 146 to form a fan of liquid diverging outward through diffuser 142. Impingement surface 146 and the opposed diffuser surface 148 converge toward one another at a predetermined compression angle θ, indicated in FIG. 7*b*, over the length from throat 136 to outlet 124. Thus while diffuser 142 diverges at angle β with respect to a first plane, e.g., the plane of diffuser surface 148 (parallel to the sheet of the fan spray), it also converges at angle θ in an orthogonal plane to the first plane, e.g., the viewing plane of FIG. 7*b* (normal to the sheet of the fan spray). Outlet 124 of the injector body is defined in an exterior outlet surface of the injector body, defining an outlet surface 144 that is oriented obliquely with respect to impingement surface 146. The adjacent portion of impingement plate 110 is not flush with outlet surface 144, but rather protrudes slightly downstream. This allows for machining tolerance while preventing impingement plate 110, which in fuel injection applications is exposed to relatively high temperatures, from sinking below the outlet surface 144 of the relatively cool injector ring 102, which in fuel injection applications is relatively cool, due to thermal expansion/contraction. Preventing the downstream surface of impingement plate 110 from sinking below the outlet surface 144 therefore reduces carbon or coke build up on impingement plate 110.

Continuing to refer to FIG. 7*b*, the air gap 139 between the land 138 and impingement surface 146 serves not only to assist in fuel distribution but also to prevent direct thermal conduction to the fuel passages within the multi-point injector 100 from the downstream face of outlet surface 144, which is exposed to the region of combustion in gas turbine engine applications, for example. Gap 139 is thus a means of reducing and/or preventing carbon deposition within the fuel passages.

Referring again to FIGS. 6 and 7*a*, multi-point injector 100 works by injecting a relatively low flow of air upstream of fuel inlet 140. The air flow is limited by the size of the rectangular air channels 134 on either side of land 138 in addition to a small open air gap 139 between land 138 and impingement surface 146. The air is limited within these passages, upstream of throat 136 and fuel inlet 140 such that changes in fuel flow do not alter the rate of air flow. Air channels 134 converge on either side of the narrowing tapered center body of land 138 merging into one air stream at throat 136 similar to a convergent-divergent nozzle. After passing throat 136, the side walls in the plane of the flat fan spray diverge at angle β, as the chamber of diffuser 142 also converges at angle θ, as described above. This convergent angle θ is sufficient to compensate for the divergent angle β in the orthogonal plane and therefore the chamber downstream of throat 136 has a near constant cross-sectional area. The relationship of angles θ and β controls air velocity and therefore controls the liquid sheet thickness and droplet size so that the spray pattern can be tailored to desired conditions. While shown and described with an exemplary configuration having a single fuel inlet 140, those skilled in the art will readily appreciate that any suitable number of fuel ports can be included in the center land 138, as needed to provide desired spray characteristics from application to application.

Figure 10:
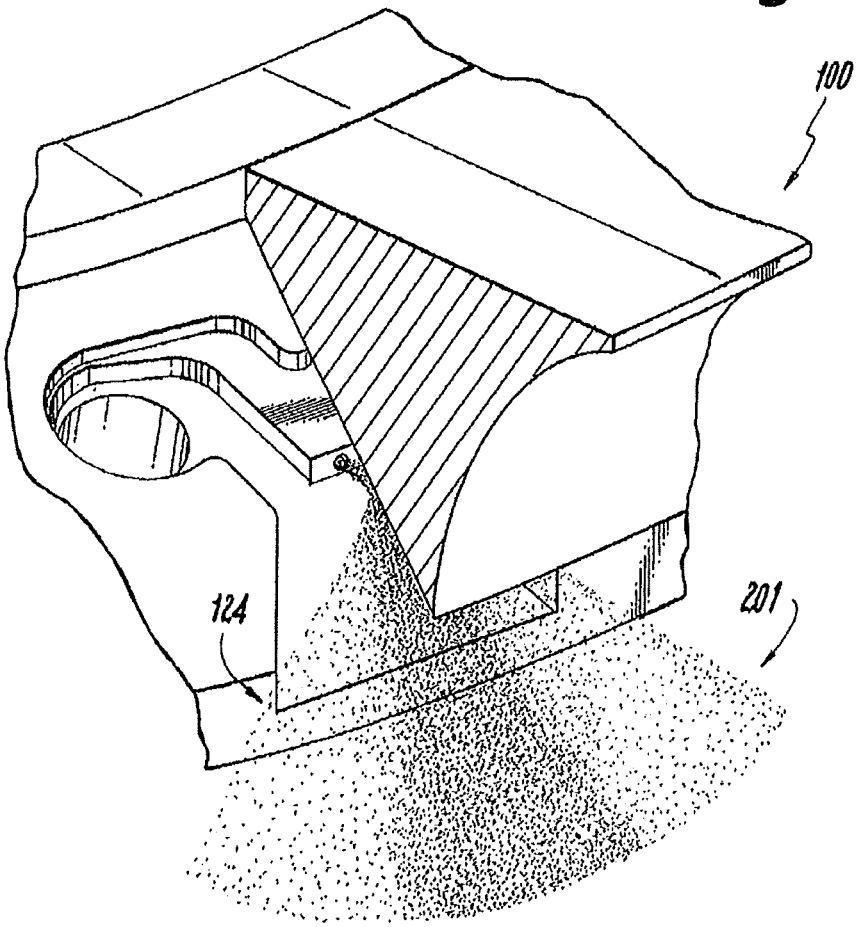
FIG. 10 is a partial cross-sectional perspective view of the fuel and air injection chamber of the injector ring of FIG. 6, schematically showing the fan shape of a spray pattern.
Figure 11:
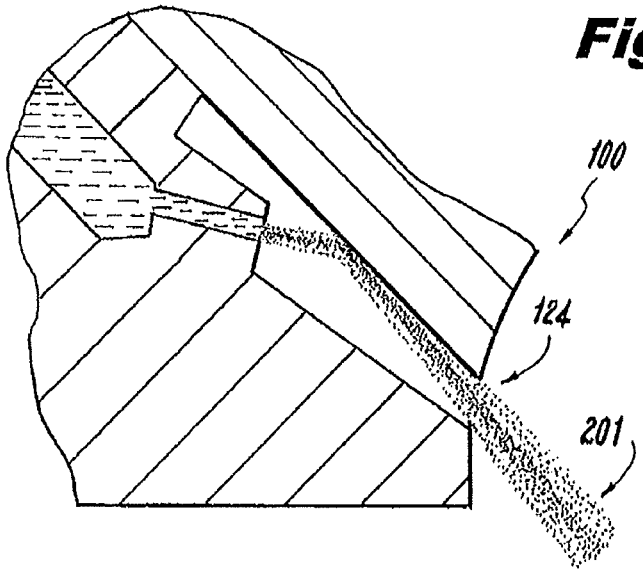
FIG. 11 is a cross-sectional view of the injector of FIG. 10, schematically showing the linear profile of the spray pattern as viewed normal to the plane of the fan shape of the spray pattern of FIG. 10.

Referring now to FIGS. 8-9, the spray pattern of the injector body is described. Diffuser 142, air channels 134, land 138, and impingement surface 146 form a chamber in which fuel and air are mixed together into a thin sheet in the general shape of a fan. The views of FIGS. 8 and 9 correspond to those in FIGS. 6 and 7*b*, respectively, but show the flow of fuel and air through the injector body schematically with arrows. As indicated by the light arrows in FIGS. 8-9, air flows in from inlets 112, through channels 134, and diverges out through diffuser 142. A portion of the air flow can also flow over land 138. As indicated by the dark arrows in FIGS. 8-9, fuel bore 132 and fuel inlet 140 in the injector ring 102 are angled obliquely with respect to impingement surface 146, to form an obtuse angle γ (the supplementary angle of angle Φ in FIG. 7*b*, described below) in the flow of liquid fuel issuing from fuel inlet 140 at a point 141 where the flow of fuel meets impingement surface 146. This impinging action causes the fuel flow to fan out from the point 141 of impingement, as indicated by the dark arrows in FIG. 8. The diverging air flow in diffuser 142 further spreads the fan of fuel flow outward in a fan shape. The converging angle θ, shown in FIG. 7*b*, causes a convergence of air and fuel flow in the plane of the spray fanning, producing a flat, fan shaped flow as shown in FIGS. 10 and 11, which show the spray of fuel exiting outlet 124 as described below. Viewed from the angle of FIG. 10, the spray has a fan shape, whereas viewed from the angle of FIG. 11, the spray has a thin line profile proximate outlet 124, which gradually dissipates downstream thereof.

The fuel exits land 138 at an angle Φ, which is measured from the centerline defined by the bore of fuel inlet 140 to impingement surface 146 as indicated in FIG. 7*b*. This angle Φ is configured so as to impinge fuel from inlet 140 upon impingement surface 146, into a direction parallel to the plane of the fan spray, as depicted in FIGS. 7*b* and 9. This impingement angle Φ is advantageously greater than about 0° and less than about 90°. This range of impingement angle Φ forces the fuel to spread out in a fan-like pattern as described above. If the impingement angle Φ is too small, the fuel stream will exit the device without impinging on impingement surface 146, therefore greatly reducing the fuel dispersion, though not completely eliminating dispersion, since the air will still entrain the fuel pulling the fuel jet open. If the impingement angle Φ is too great, fuel will disperse in all directions, including upstream directions, instead of dispersing downstream in a fan shape. Fuel flow upstream of the fuel exit can lead to reduced dispersal and/or even entrapment of fuel in low air velocity regions. This can in turn lead to carbon deposition within the mixing chamber, since the air for gas turbine applications, e.g., compressor discharge air, can be significantly above 400° F. Therefore a more advantageous impingement angle range is from about 20° to about 60° to ensure proper fan shape while minimizing the risk of back flow. If fuel inlet 140 is positioned upstream of throat 136, the impingement angle will tend to be smaller to limit or prevent the fuel from impinging on the throat wall, i.e., the side walls of chamber 125 that diverge from throat 136, which would otherwise lead to heavier streaks of fuel at the device's exit.

Multi-point injector 100 includes ten individual injectors as described above, evenly spaced about its circumference, see, e.g., FIG. 3*a*. Those skilled in the art will readily appreciate that any suitable number of injectors can be used, depending on the specific application. Moreover, it is not necessary that multiple injectors be arranged around a ring, rather, multiple or individual injectors can be arranged in any suitable shape or configuration without departing from the spirit and scope of the invention. In ring or in individual configurations, the components of multi-point injectors such as described above can be formed by machining, sintering, injection molding, and/or any other suitable process or processes. Advantageously, most of the features of the fuel and air chamber described above are formed in a single surface, i.e., all of the features of the chamber except impingement surface 146 are formed in a surface of injector ring 102.

With reference now to FIGS. 10 and 11, the fan shaped spray pattern 201 is indicated with stippling. Injector 100 works most optimally for fuel pressures sufficiently high to create impingement on the opposing wall (e.g., impingement surface 146), while low enough to prevent the propagation of a coherent fuel jet down the center of the spray pattern. Performance varies with the size of the fuel exit orifice (e.g., fuel inlet 140). Increasing the impingement angle (e.g., angle Φ) tends to decrease streaking at higher fuel pressures, but leads to multiple smaller streaks at lower fuel pressures. The addition of a small countersink (not visible in the drawings) at the fuel exit orifice (20-60° full angle) aids in the dispersion of the fuel jet and improves homogeneous distribution of the fuel at all pressures and flow rates.

In some applications, it may be desirable to further enhance the impinging, fanning effects described above. To this end, in FIG. 12, another exemplary embodiment of an injector body

300 is shown, having an injector ring 302, impingement plate 310, air inlets 312, air channels 334 (shown in FIG. 12), land 338, fuel inlet 340, throat 336, and diffuser 342 similar to those described above with respect to multi-point injector 100. An additional air inlet, namely impingement air inlet 350, is positioned in throat 336 proximate fuel inlet 340 and opposite impingement surface 346. Air introduced through bore 352, shown in FIG. 13, and air inlet 350 towards impingement surface 346 urges fuel spray from fuel inlet 340 into impingement surface 346 to further enhance the break up of the jet of fuel from fuel inlet 340 into the fan shape depicted in FIGS. 8-11.

While described herein in the exemplary context of fuel injection for gas turbine engines, those skilled in the art will readily appreciate that the systems and methods described herein can be applied to other applications where it is desirable to provide a flat fan spray pattern. Any other suitable liquid besides fuel can be used without departing from the spirit and scope of the invention. The systems and methods described above have been described in the exemplary context of the multi-point outer fuel injector of U.S. Provisional Patent Application No. 61/454,356 as shown in FIG. 1*a*, in which air through a swirling device passes on the inside and/or the outside of the ring to supply additional oxidizer for a combustion system. The flat fan spray patternation of the devices of the subject invention provide a fixed fuel trajectory for placement of fuel with spray penetration through layers of compressor discharge air to allow fuel to mix with recirculating combustion products prior to combusting. The assist air co-injected with the fuel is for atomization only and the fuel spray does not fully premix or burn prematurely with the co-injected air. Those skilled in the art will readily appreciate this application is exemplary, and that multiple or single point injectors as described above can be used in any other suitable application without departing from the spirit and scope of the invention. As one such example, multi-point injectors as described herein can be used to spray coolant in steel mill applications and the like, due to the uniform spray and droplet size resulting from the air assist.

The exemplary embodiments described above use up to two feed tubes feeding a common fuel passage leading to all of the multiple injection points. Those skilled in the art will readily appreciate that any suitable number of fuel passages can be provided to allow for fuel staging to individual injection points with any suitable number of stages and any suitable number of injection points per stage.

The methods and systems of the present invention, as described above and shown in the drawings, provide for injectors with superior properties including flat, fan shaped spray patternation. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. An injector for injecting a flat fan of liquid comprising:

a) an injector body defining a pair of air channels, each air channel fluidly connected to a respective air inlet, wherein the air channels join one another at a common throat defined in the injector body and are separated by a land defined in the injector body extending from the air inlets to a point proximate the throat;

b) a liquid inlet defined in the land proximate the throat, wherein the air channels and liquid inlet are in proximity to draw liquid out of the liquid inlet into the throat with air flowing through the air channels; and c) a diffuser in fluid communication with the throat, wherein the diffuser has a width that diverges over a length from the throat to an outlet of the injector body, wherein the diffuser includes an impingement surface defined in the injector body opposed to the liquid inlet, and wherein the liquid inlet is configured to inject liquid against the impingement surface to form a fan of liquid spray diverging outward through the diffuser.

2. An injector as recited in claim 1, wherein the diffuser includes a diffuser surface opposite the impingement surface, wherein the diffuser surface and the impingement surface converge toward one another at a predetermined compression angle over the length from the throat to the outlet of the injector body.

3. An injector as recited in claim 1, wherein the liquid inlet includes a liquid inlet bore in the injector body that is angled obliquely with respect to the impingement surface of the diffuser, the liquid inlet and liquid inlet bore being configured and adapted to form an obtuse angle in a flow of liquid issuing from the liquid inlet at a point where the flow of liquid meets the impingement surface of the diffuser.

4. An injector as recited in claim 1, further comprising an impingement air inlet opposite the impingement surface of the diffuser downstream of the liquid inlet, wherein the impingement air inlet is configured and adapted to inject a jet of air toward the impingement surface and toward a flow of liquid issuing from the liquid inlet to enhance impingement of the flow of liquid on the impingement surface.

5. An injector as recited in claim 1, wherein the outlet of the injector body is defined in an exterior outlet surface of the injector body, wherein the outlet surface is oriented obliquely with respect to the impingement surface of the diffuser.

6. An injector as recited in claim 1, wherein the liquid inlet is offset upstream from the throat of the diffuser.

7. A multi-point injector comprising:

a) an injector ring having a liquid opening for receiving liquid from an external source, the opening being in fluid communication with an internal liquid passage within the injector ring, the injector ring including a plurality of injectors, each injector including:

i) a pair of air channels, each air channel fluidly connected to a respective air inlet, wherein the air channels join one another at a common throat defined in the injector ring and are separated by a land defined in the injector ring extending from the air inlets to a point proximate the throat;

ii) a liquid inlet defined in the land proximate the throat in fluid communication with the internal liquid passage of the injector ring, wherein the air channels and liquid inlet are in proximity to draw liquid out of the liquid inlet into the throat with air flowing through the air channels; and iii) a diffuser in fluid communication with the throat, wherein the diffuser has a width that diverges over a length from the throat to an outlet of the injector, wherein the diffuser includes an impingement surface defined in the injector ring opposed to the liquid inlets, and wherein each liquid inlet is configured to inject liquid against the impingement surface to form a fan of liquid spray diverging outward through the diffuser thereof.

8. A multi-point injector as recited in claim 7, wherein the diffuser of each injector includes a diffuser surface opposite the impingement surface, wherein the diffuser surface and the impingement surface converge toward one another at a predetermined compression angle over the length from the throat to the outlet of the injector.

9. A multi-point injector as recited in claim 7, wherein the liquid inlet of each injector includes a liquid inlet bore in the injector ring that is angled obliquely with respect to the impingement surface of the diffuser of the injector, the liquid inlet and liquid inlet bore being configured and adapted to form an obtuse angle in a flow of liquid issuing from the liquid inlet at a point where the flow of liquid meets the impingement surface of the diffuser of the injector.

10. A multi-point injector as recited in claim 7, wherein each injector includes an impingement air inlet opposite the impingement surface of the diffuser downstream of the liquid inlet, wherein the impingement air inlet is configured and adapted to inject a jet of air toward the impingement surface and toward a flow of liquid issuing from the liquid inlet to enhance impingement of the flow of liquid on the impingement surface.

11. A multi-point injector as recited in claim 7, wherein the outlet of each injector is defined in an exterior outlet surface of the injector ring, wherein the outlet surface is oriented obliquely with respect to the impingement surface of the diffuser.

12. A multi-point injector as recited in claim 7, wherein the liquid inlet of each injector is offset upstream from the throat of the diffuser.

13. A multi-point injector comprising:

a) a liquid distributor ring having a liquid opening for receiving liquid from an external source;

b) an injection manifold ring mounted to the liquid distributor ring with an internal liquid passage in fluid communication with the liquid opening, the internal liquid passage defined between the liquid distributor ring and the injection manifold ring, wherein the injection manifold ring includes a plurality of injectors, each injector including:

i) a pair of air channels, each air channel fluidly connected to a respective air inlet defined radially through the injection manifold ring, wherein the air channels join one another at a common throat defined in the injection manifold ring and are separated by a land defined in the injection manifold ring extending from the air inlets to a point proximate the throat;

ii) a liquid inlet defined in the land proximate the throat in fluid communication with the internal liquid passage, wherein the air channels and liquid inlet are in proximity to draw liquid out of the liquid inlet into the throat with air flowing through the air channels; and iii) a diffuser in fluid communication with the throat, wherein the diffuser has a width that diverges over a length from the throat to an outlet of the injector; and c) an impingement ring mounted to the injection manifold ring, wherein the impingement ring includes an impingement surface disposed opposed to the liquid inlet of the injection manifold ring, and wherein each liquid inlet is configured to inject liquid against the impingement surface to form a fan of liquid spray diverging outward through the diffuser thereof.

14. A multi-point injector as recited in claim 13, further comprising a heat shield ring mounted to the liquid distributor ring and to the injection manifold ring, wherein an insulation space is defined between a radially outer surface of the heat shield ring and the internal liquid passage to thermally isolate the internal liquid passage from conditions external to the heat shield ring.

15. A multi-point injector as recited in claim 14, wherein the heat shield ring forms a portion of the internal liquid passage with the liquid distributor ring.

16. A multi-point injector as recited in claim 13, wherein the diffuser of each injector includes a diffuser surface opposite the impingement surface, wherein the diffuser surface and the impingement surface converge toward one another at a predetermined compression angle over the length from the throat to the outlet of the injector.

17. A multi-point injector as recited in claim 13, wherein the liquid inlet of each injector includes a liquid inlet bore in the injection manifold ring that is angled obliquely with respect to the impingement surface of the impingement ring, the liquid inlet and liquid inlet bore being configured and adapted to form an obtuse angle in a flow of liquid issuing from the liquid inlet at a point where the flow of liquid meets the impingement surface.

18. A multi-point injector as recited in claim 13, wherein each injector includes an impingement air inlet opposite the impingement surface of the impingement ring downstream of the liquid inlet, wherein the impingement air inlet is configured and adapted to inject a jet of air toward the impingement surface and toward a flow of liquid issuing from the liquid inlet to enhance impingement of the flow of liquid on the impingement surface.

19. A multi-point injector as recited in claim 13, wherein the outlet of each injector is defined in an exterior outlet surface of the injection manifold ring, wherein the outlet surface is oriented obliquely with respect to the impingement surface of the impingement ring.

20. A multi-point injector as recited in claim 13, wherein the liquid inlet of each injector is offset upstream from the throat of the diffuser.

* * * * *